US011846905B2

(12) United States Patent
Kyotani et al.

(10) Patent No.: US 11,846,905 B2
(45) Date of Patent: Dec. 19, 2023

(54) IMAGE FORMING DEVICE PERFORMING PRELIMINARY PROCESS TO ROTATE ROLLER AT DETERMINED ROTATIONAL SPEED

(71) Applicant: BROTHER KOGYO KABUSHIKI KAISHA, Nagoya (JP)

(72) Inventors: Tadao Kyotani, Nagoya (JP); Yoshihiro Itogawa, Mizuho (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/557,356

(22) Filed: Dec. 21, 2021

(65) Prior Publication Data

US 2022/0206423 A1 Jun. 30, 2022

(30) Foreign Application Priority Data

Dec. 25, 2020 (JP) ..... 2020-217933

(51) Int. Cl.
*G03G 15/00* (2006.01)
*G03G 15/20* (2006.01)

(52) U.S. Cl.
CPC ..... *G03G 15/5008* (2013.01); *G03G 15/2028* (2013.01)

(58) Field of Classification Search
CPC ..... G03G 15/5028; G03G 15/2028
See application file for complete search history.

(56) References Cited

U.S. PATENT DOCUMENTS

2005/0271411 A1 12/2005 Shibaki et al.
2017/0297338 A1 10/2017 Arakane

FOREIGN PATENT DOCUMENTS

| | | | | |
|---|---|---|---|---|
| EP | 1 107 104 | A2 | | 6/2001 |
| JP | H08179636 | A | * | 7/1996 |
| JP | 2001-150761 | A | | 6/2001 |
| JP | 2006-021527 | A | | 1/2006 |
| JP | 2009175629 | A | * | 8/2009 |
| JP | 2017-193053 | A | | 10/2017 |

* cited by examiner

*Primary Examiner* — Victor Verbitsky
(74) *Attorney, Agent, or Firm* — Scully, Scott, Murphy & Presser, P.C.

(57) ABSTRACT

In an image forming device, a photosensitive drum forms an image on a sheet based on the image formation data. The roller conveys the sheet. A motor provides the roller with driving force to rotate the roller. A controller acquires an advance command which is received from the external terminal prior to reception of the image formation data. The advance command includes option information. The controller determines a rotational speed of the roller based on the option information. The rotational speed is determined to be changeable depending on the optional information. The controller performs a preliminary process before the photosensitive drum forms an image on the sheet based on the image formation data. The preliminary process is to control the motor so that the roller rotates at the rotational speed determined in the determining.

10 Claims, 11 Drawing Sheets

IMAGE FORMATION PROCESS OF S140

IMAGE FORMING DEVICE PERFORMING PRELIMINARY PROCESS TO ROTATE ROLLER AT DETERMINED ROTATIONAL SPEED

CROSS REFERENCE TO RELATED APPLICATION

This application claims priority from Japanese Patent Application No. 2020-217933 filed Dec. 25, 2020. The entire content of the priority application is incorporated herein by reference.

BACKGROUND

Techniques have been proposed for shortening a first printing time on an image forming device. The first printing time is the time required for the trailing edge of a first sheet to be discharged from the image forming device after a command to perform image formation is issued. For example, one image forming device proposes that the start of a preliminary process is triggered by an advance command received prior to the image formation data. The preliminary process may include rotating the heating roller in the fixing portion and raising the temperature of the heater in the fixing portion, for example.

The conventional printing device described above shortens the first printing time by performing processes for spooling print data and warming up the printing device in parallel. The warm-up process on this printing device is triggered by start-up data received prior to the print data.

SUMMARY

During the preliminary process executed according to the advance command, the roller for conveying sheets is normally rotated constantly at full speed. In a conceivable case that the roller is to be rotated at a speed other than full speed, such as half speed, during an image forming process executed according to the image formation data, the printing device has to change the speed of the motor that drives the roller in order to transition from the preliminary processes to the image formation process. Consequently, extra time is required for transitioning from the preliminary processes to the image formation process.

In view of the foregoing, it is an object of the present disclosure to provide an image forming device and an image formation method capable of quickly transitioning to the image formation process even when the roller is to be rotated at a speed other than full speed during the image formation process executed according to image formation data.

In order to attain the above and other objects, the disclosure provides an image forming device includes an image forming portion, and a controller. The image forming portion includes a photosensitive drum, a roller, and a motor. The photosensitive drum is configured to form an image on a sheet based on image formation data transmitted from an external terminal. The roller is configured to convey the sheet. The motor is configured to provide the roller with driving force to rotate the roller. The controller is configured to perform: acquiring an advance command which is received from the external terminal prior to reception of the image formation data, the advance command including option information; determining a rotational speed of the roller based on the option information, the rotational speed being determined to be changeable depending on the optional information; and a preliminary process before the photosensitive drum forms an image on the sheet based on the image formation data, the preliminary process being to control the motor so that the roller rotates at the rotational speed determined in the determining According to the configurations, the rotational speed of the roller can be set to be coincident with that when an image is formed, and thus there is no need to change the rotational speed while transitioning from the preliminary process to the image formation process. Accordingly, the transitioning from the preliminary process to the image formation process can be executed quickly.

According to another aspect, the disclosure provides a method. The method includes acquiring an advance command which is received from an external terminal prior to reception of image formation data, the advance command including option information; determining a rotational speed of a roller provided in an image forming portion based on the option information, the rotational speed being determined to be changeable depending on the optional information, the roller being configured to convey the sheet; and performing a preliminary process before a photosensitive drum provided in the image forming portion forms an image on a sheet based on the image formation data, the preliminary process being to control a motor provided in the image forming portion so that the roller rotates at the rotational speed determined in the determining, the motor being configured to provide the roller with driving force to rotate the roller. According to the configurations, the rotational speed of the roller can be set to be coincident with that when an image is formed, and thus there is no need to change the rotational speed while transitioning from the preliminary process to the image formation process. Accordingly, the transitioning from the preliminary process to the image formation process can be executed quickly.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
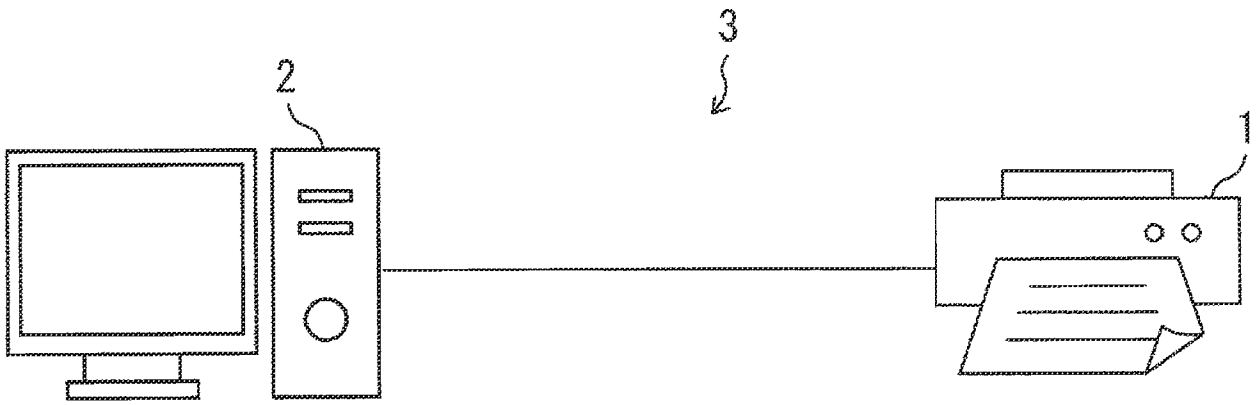
FIG. 1 is a block diagram showing configuration of an image formation system.

An embodiment will be described while referring to the drawings.

Configuration of an Image Formation System

An image formation system 3 according to an embodiment of the present disclosure will be described with reference to FIG. 1. FIG. 1 is a block diagram showing the configuration of the image formation system 3.

The image formation system 3 includes an image forming device 1, and an external terminal 2 connected to and capable of communicating with the image forming device 1. The image forming device 1 functions to form images on sheets. The external terminal 2 functions to command the image forming device 1 to form images on sheets. In the embodiment, a multifunction peripheral (MFP) serves as the image forming device 1, while a personal computer (PC) serves as the external terminal 2.

Note that while the image formation system 3 depicted in FIG. 1 includes a single external terminal 2, the image formation system 3 is not limited to this number and may include two or more external terminals 2. Further, the image formation system 3 may include one or more external terminals 2 other than PCs, such as smartphones or tablet computers.

Structure of the Image Forming Device

Figure 2:
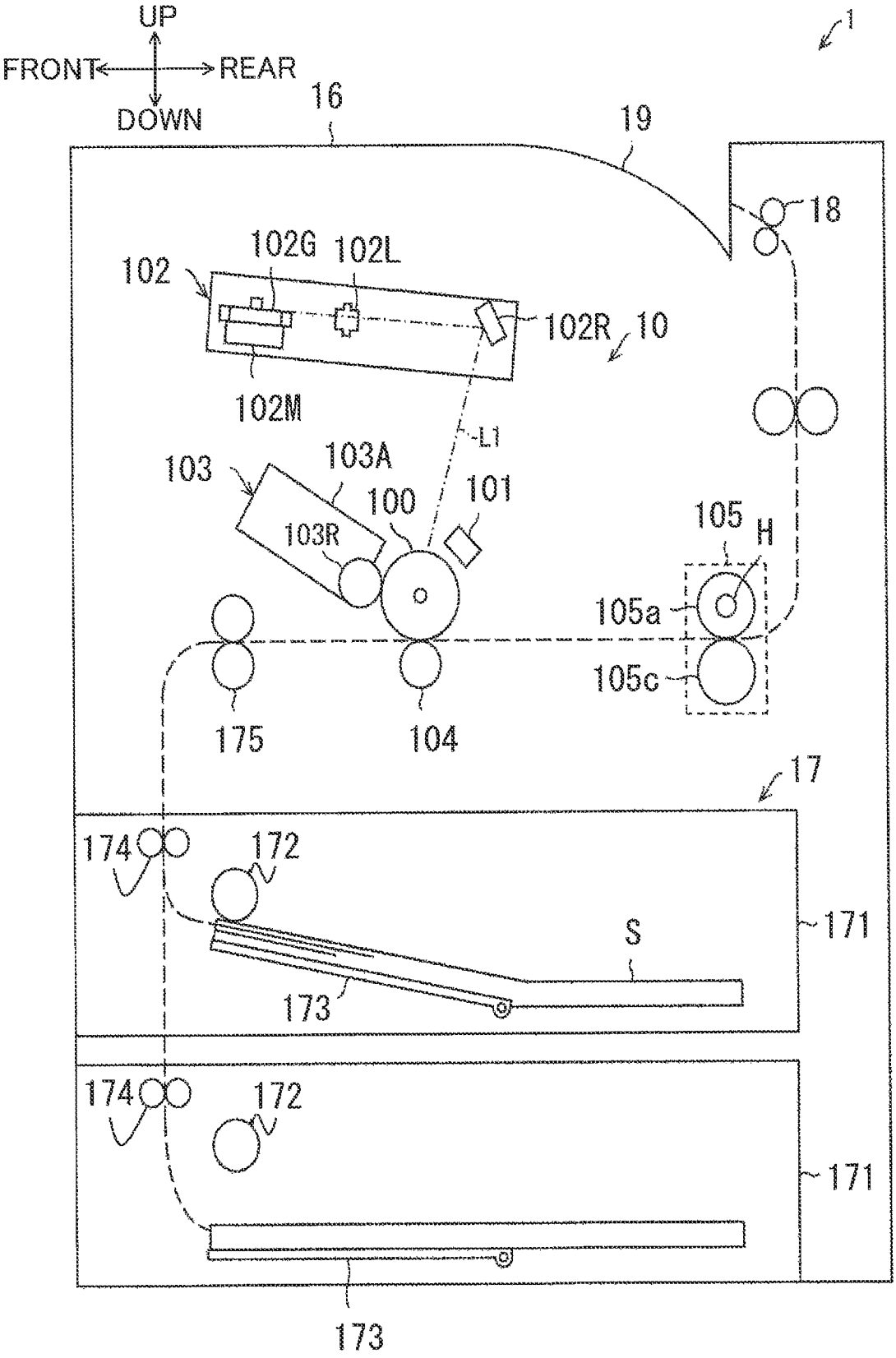
FIG. 2 is an explanation diagram showing an internal structure of an image forming device.
Figure 3:
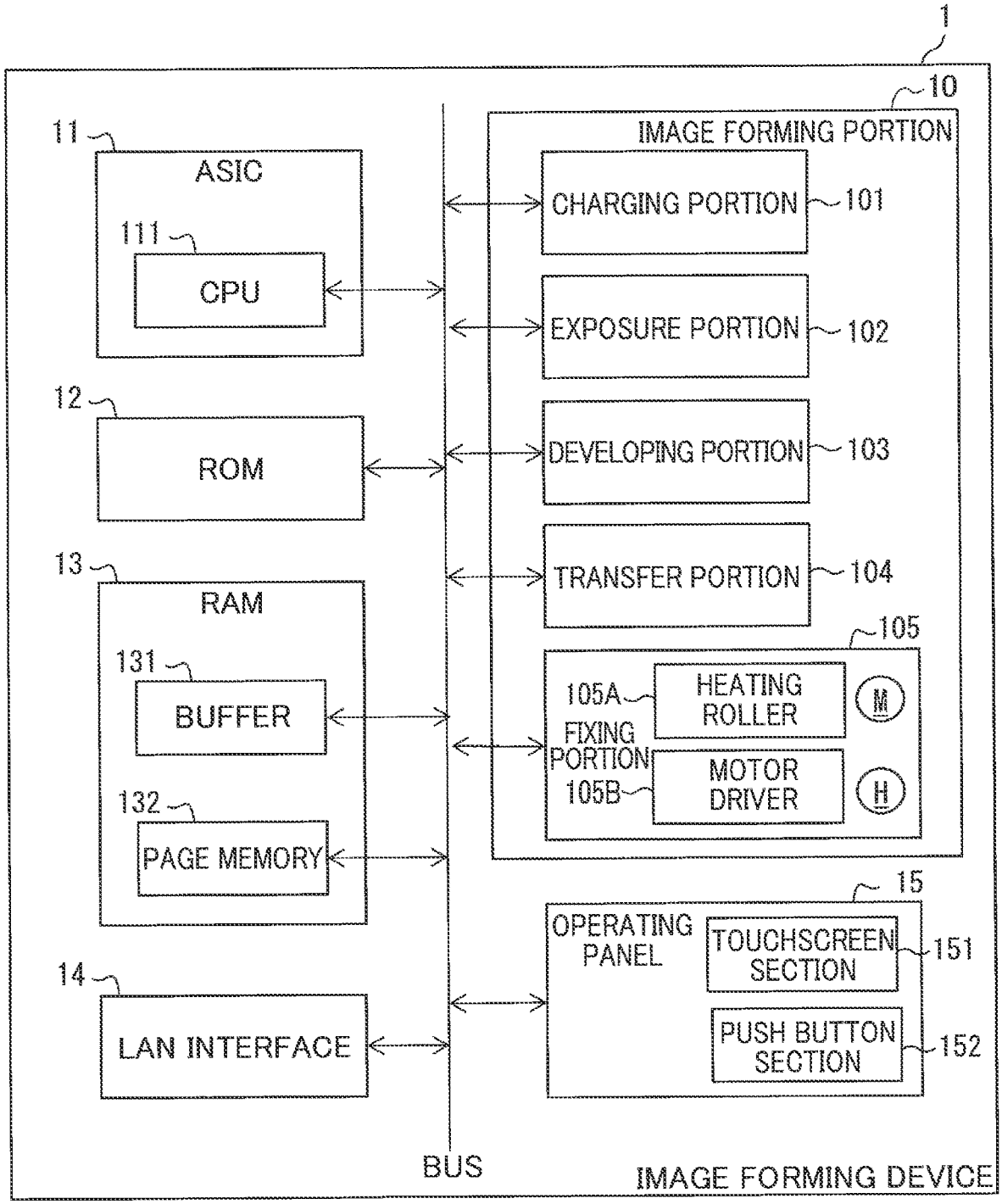
FIG. 3 is a block diagram showing components of the image forming device and their electrical configuration.

Next, the structure of the image forming device 1 will be described with reference to FIGS. 2 and 3. FIG. 2 shows the internal structure of the image forming device 1. FIG. 3 is a block diagram showing components of the image forming device 1 and their electrical configuration.

As shown in FIG. 2, the image forming device 1 is provided with a main casing 16, a sheet-feeding portion 17, a discharge roller 18, and a discharge tray 19. The main casing 16 accommodates the sheet-feeding portion 17 and the discharge roller 18. The discharge tray 19 is formed on the top surface of the main casing 16.

The sheet-feeding portion 17 feeds sheets S. The sheet-feeding portion 17 is provided with a tray 171, a feed roller 172, a sheet-pressing plate 173, a conveying roller 174, and a registration roller 175. The tray 171 is a sheet tray accommodating sheets S. The feed roller 172 feeds the sheets S from the tray 171.

To feed sheets S, the sheet-pressing plate 173 presses the sheets S in the tray 171 against the feed roller 172, and the rotating feed roller 172 feeds the sheets S one at a time to the conveying roller 174. The conveying roller 174 conveys each sheet S toward the registration roller 175. After adjusting the sheet S so that its leading edge is aligned in the width direction, the registration roller 175 conveys the sheet S toward an image forming portion 10 described below. The image forming portion 10 forms an image on the sheet S fed by the sheet-feeding portion 17. After an image has been formed on the sheet S, the discharge roller 18 discharges the sheet S onto the discharge tray 19.

Next, the structure and operations of the image forming portion 10 will be described in greater detail with reference to FIGS. 2 and 3. The image forming portion 10 is a device that forms images on sheets S. The image forming portion 10 is provided with an exposure portion 102, a transfer portion 104, a charging portion 101, a developing portion 103, a fixing portion 105, and a photosensitive body (photosensitive drum) 100. The exposure portion 102 is provided with a laser light source (not shown), a polygon mirror 102G, a scanning lens 102L, a polygon motor 102M, and a reflecting mirror 102R.

The polygon mirror 102G is a rotatable regular hexagonal prism whose six sides constitute reflecting surfaces. The polygon mirror 102G deflects a laser beam L1 emitted by the laser light source in a direction toward the photosensitive body 100. The polygon motor 102M drives the polygon mirror 102G to rotate. The exposure portion 102 is also provided with a motor driver (not shown) for driving the polygon motor 102M.

When deflected off the polygon mirror 102G, the laser beam L1 passes through the scanning lens 102L and is reflected by the reflecting mirror 102R onto the surface of the photosensitive body 100. By scanning the laser beam L1 over the surface of the photosensitive body 100, the exposure portion 102 exposes the surface of the photosensitive body 100 to form an electrostatic latent image thereon. The polygon motor 102M is a brushless DC motor.

The transfer portion 104 is a transfer roller arranged so that the sheet S is interposed between the transfer portion 104 and the photosensitive body 100 during image formation. The charging portion 101 is a scorotron charger having a charging wire and a grid part (not shown). By applying a charge voltage to the charging wire and a grid voltage to the grid part from a high voltage generating circuit (not shown), a corona discharge is produced for uniformly charging the surface of the photosensitive body 100. The developing portion 103 is further provided with a developing roller 103R, and a developer-accommodating section 103A.

After the surface of the photosensitive body 100 has been uniformly charged by the charging portion 101, the exposure portion 102 in the image forming portion 10 emits the laser beam L1 to form an electrostatic latent image on the photosensitive body 100 based on image data. The developing roller 103R also supplies developer from the developer-accommodating section 103A to the electrostatic latent image formed on the photosensitive body 100, thereby developing the latent image into a visible image. In other words, a developer image is formed on the photosensitive body 100. Subsequently, a sheet S supplied from the sheet-feeding portion 17 is conveyed to a transfer position between the photosensitive body 100 and the transfer portion 104, and the developer image formed on the photosensitive body 100 is transferred onto the sheet S.

After the developer image has been transferred onto the sheet S, the sheet S is conveyed to the fixing portion 105 by the photosensitive body 100 and the transfer portion 104. The fixing portion 105 thermally fixes the developer image to the sheet S conveyed from the photosensitive body 100 and the transfer portion 104. The fixing portion 105 is provided with a heating roller 105*a*, a pressure roller 105*c*, and a heater H. The fixing portion 105 uses the heater H to apply heat to the sheet S on which an image has been formed.

The heating roller 105*a* heats the sheet S. The pressure roller 105*c* pinches the sheet S against the heating roller 105*a*. The heater H is arranged inside the heating roller 105*a* for raising the temperature of the same. The heater H is a halogen lamp, for example. Thus, after a developer image has been transferred onto a sheet S, the developer image is thermally fixed to the sheet S in the fixing portion 105 by conveying the sheet S between the heating roller 105*a* and the pressure roller 105*c*. After the developer image is fixed to the sheet S, the discharge roller 18 discharges the sheet S onto the discharge tray 19. The heating roller 105*a* is an example of the roller. The fixing portion 105 is not limited to the configurations having the heating roller 105*a* and the heater H to raise the temperature of the heating roller 105*a*. For example, the fixing portion 105 may include a heating belt, a pressure roller, a nip plate, and a heater. The heating belt is an endless belt. The heater and the nip plate are located in an interior space of the heating belt. The heater may be a halogen ramp generating radiant heat. The heating belt and the pressure roller are in contact with each other to form a nip. The pressure roller presses the heating belt. The recording sheet passes through the nip. The nip plate is in contact with the inner surface of the heating belt. The nip plate receives radiant heat generated from the heater to raise the temperature of the heating belt.

Alternatively, the fixing portion 105 may include a heating belt, a pressure roller, and a heater. The heating belt is an endless belt. The heater is located in an interior space of the heating belt. The heater in this case includes a circuit board and a heating pattern having a specific shape (pattern). The heating pattern is a heat element (a resistor) generating heat by electric power. The heating belt and the pressure roller are in contact with each other to form a nip. The pressure roller presses the heating belt. The recording sheet passes through the nip. The heater is in contact with the inner surface of the heating belt to raise the temperature of the heating belt.

Alternatively, the fixing portion 105 may include a heating roller, a pressure belt, and a heater. The heater is located in an interior space of the heating roller. The pressure belt is an endless belt. The heating roller and the pressure belt are contact with each other to form a nip. The pressure belt presses the heating roller. The recording sheet passes through the nip. The heater is a halogen ramp, for example, to generate heat to raising the temperature of the heating roller. In the examples of the fixing portion described above, a roller may replace any endless belt such as the heating belt, and/or an endless belt may replace any roller such as the pressure roller.

As shown in FIG. 3, the image forming device 1 is provided with the image forming portion 10 described above, an application-specific integrated circuit (ASIC) 11, a read-only memory (ROM) 12, a random-access memory (RAM) 13, a local area network (LAN) interface 14, and an operating panel 15. The image forming portion 10, the ASIC 11, the ROM 12, the RAM 13, the LAN interface 14, and the operating panel 15 are interconnected via a bus.

The image forming portion 10 is a device that forms images on sheets S. As shown in FIGS. 2 and 3, the image forming portion 10 in the embodiment is configured of the charging portion 101, the exposure portion 102, the developing portion 103, the transfer portion 104, and the fixing portion 105.

The charging portion 101 is configured to uniformly charge the surface of the photosensitive body 100. The exposure portion 102 is a device for forming electrostatic latent images on the surface of the uniformly charged photosensitive body 100 using a laser beam. The developing portion 103 is a device for developing a visible image with developer from an electrostatic latent image formed on the surface of the photosensitive body 100. The transfer portion 104 is a device for transferring the developer image formed on the surface of the photosensitive body 100 onto the surface of a sheet S using a transfer roller. The fixing portion 105 is a device for fixing the developer image transferred onto the surface of the sheet S using the heating roller 105*a*, as described above.

The temperature of the heating roller 105*a* is raised by supplying an electric current to the heater H. The fixing portion 105 is also provided with a motor M and a motor driver 105*b* (FIG. 3). The motor M is rotated to apply a drive force to the heating roller 105*a*. The motor M may apply a drive force to the pressure roller 105*c* by its rotation. The motor driver 105*b* drives the motor M to rotate. Thus, the motor driver 105*b* controls the rotational speed of the motor M and, hence, the rotational speed of the heating roller 105*a*. The motor driver 105*b* is an example of the drive portion. The motor M may apply drive force to the photosensitive body 100, the feed roller 172, the conveying roller 174, the registration roller 175, and/or the discharge roller 18.

The ASIC 11 has a built-in central processing unit (CPU) 111. The CPU 111 is a device for controlling components in the image forming device 1, such as the image forming portion 10 described above and the operating panel 15 described later. The ROM 12 stores various programs and parameters for controlling components in the image forming device 1. The CPU 111 controls the components in the image forming device 1 according to the programs stored in the ROM 12 while referencing the parameters stored in the ROM 12. The CPU 111 functions as the controller of the image forming device 1, while the ROM 12 functions as the storage of the image forming device 1.

The LAN interface 14 is configured to receive various commands and data from the external terminal 2. Examples of commands and data that the LAN interface 14 receives from the external terminal 2 may be an advance command and image formation data described later. The RAM 13 is provided with a buffer 131, and a page memory 132. The buffer 131 is provided for temporarily storing various commands and data received by the LAN interface 14. For example, an advance command and image formation data that the LAN interface 14 receives from the external terminal 2 are temporarily stored in the buffer 131. The page memory 132 is provided for temporarily storing data generated by the CPU 111. For example, raster data that the CPU 111 generates from the image formation data is temporarily stored in the page memory 132. The RAM 13 functions as the storage of the image forming device 1, and the LAN interface 14 functions as the communication unit of the image forming device 1.

The operating panel 15 is a device for receiving user operations. The operating panel 15 includes a touchscreen section 151, and a push button section 152, for example. The touchscreen section 151 includes a display and a touchpad. The touchscreen section 151 displays operating screens acquired from the CPU 111 on the display and provides signals to the CPU 111 representing touch operations detected by the touchpad. The push button section 152 is configured of a plurality of push buttons. The push button section 152 provides signals to the CPU 111 that represent push operations detected by the push buttons.

Operations on the External Terminal

Figure 4:
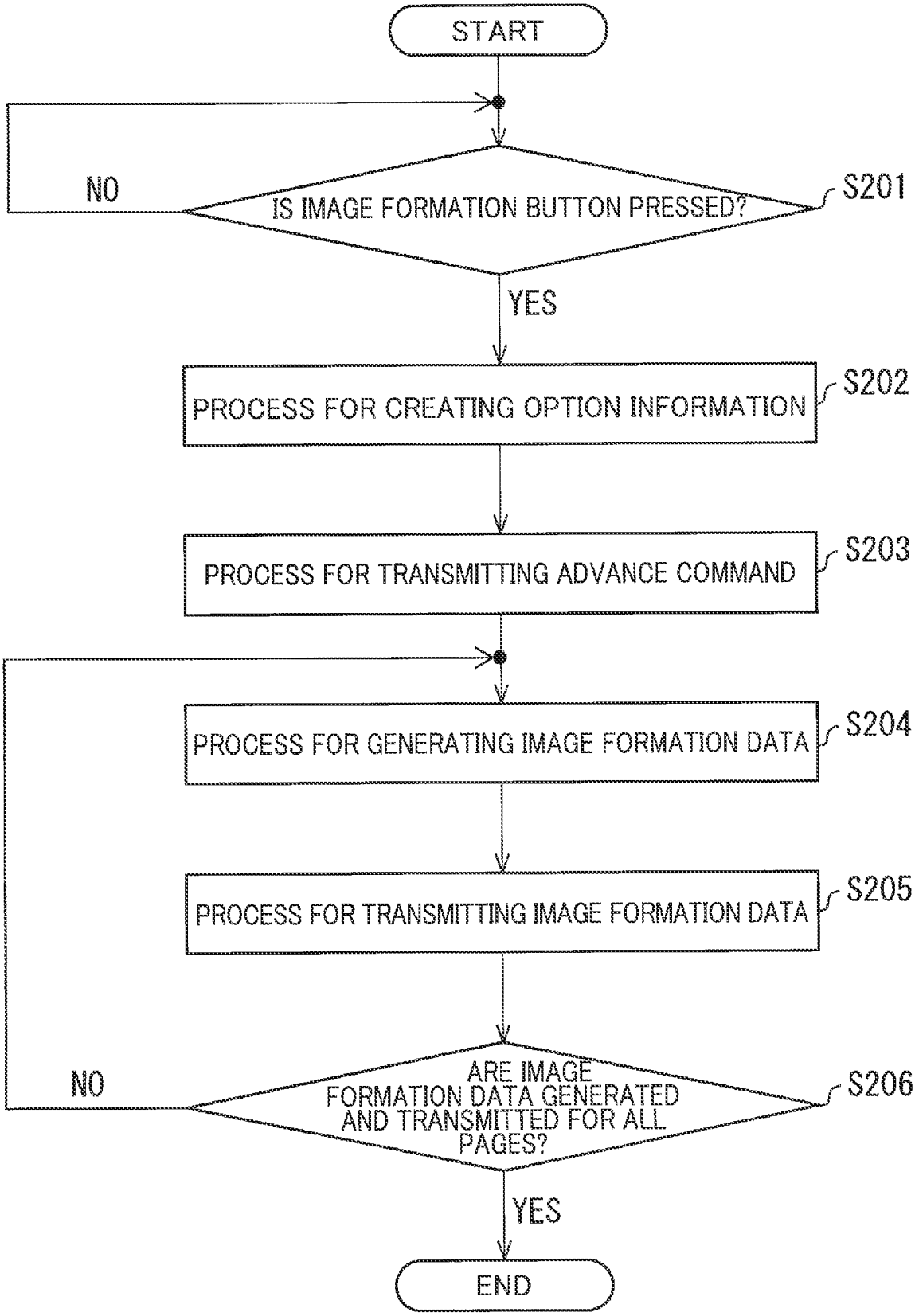
FIG. 4 is a flowchart showing operations performed on an external terminal.

Next, operations performed on the external terminal 2 will be described with reference to FIG. 4. FIG. 4 is a flowchart showing the order of operations executed on the external terminal 2.

In S201 the external terminal 2 determines whether an image formation button has been pressed and continually repeats the determination while the image formation button has not been pressed (S201: NO). When the image formation button is pressed (S201: YES), in S202 the external terminal 2 executes a process for creating option information. In this process, the external terminal 2 creates option information specifying the method to be used for forming images in the image formation process. The option information used in the embodiment includes sheet size information specifying the size of the sheets being printed, sheet type information specifying the type of sheets being printed, and image forming mode information specifying an image forming mode. The image forming mode defines a mode or method for forming an image on sheets. For example, the image forming mode includes a quiet mode and an enhanced fixing mode for enhancing fixing process to fix toner by the fixing portion 105.

In S203 the external terminal 2 executes a process for transmitting an advance command Here, the external terminal 2 transmits the advance command to the image forming device 1 via a LAN. The advance command includes the option information created in S202. The advance command used in the embodiment describes the option information in the Printer Job Language (PJL). The advance command may be a command in the form of a Universal Serial Bus (USB) control transfer.

In S204 the external terminal 2 executes a process for generating image formation data. In this process, the external terminal 2 generates image formation data specifying the method to be used for forming an image in the image formation process, and the content of the image being formed. The image formation data used in the embodiment uses PJL to describe the method for forming the image and uses Page Description Language (PDL) to describe the content of the image being formed. Note that the content of the image being formed may also be described in the Portable Document Format (PDF).

In S205 the external terminal 2 executes a process for transmitting the image formation data. In this process, the external terminal 2 transmits the image formation data generated in S204 to the image forming device 1 via the LAN. In S206 the external terminal 2 determines whether the processes in S204 and S205 for generating and transmitting image formation data have been executed for all pages. The external terminal 2 returns to S204 when there remain unprocessed pages (S206: NO). The external terminal 2 ends the process of FIG. 4 when the processes of S204 and S205 have been completed for all pages (S206: YES).

In the embodiment, the external terminal 2 employs a configuration for transmitting the advance command and the image formation data to the image forming device 1 over a LAN, but the present disclosure is not limited to this configuration. For example, the external terminal 2 may employ a configuration for transmitting the advance command and image formation data to the image forming device 1 via a USB cable. In this case, the advance command and image formation data will be transmitted to the image forming device 1 as USB commands, for example. Further, the image forming device 1 must be provided with a USB interface in place of the LAN interface 14 and must transmit the advance command and the image formation data using this USB interface.

Operations on the Image Forming Device

Figure 5:
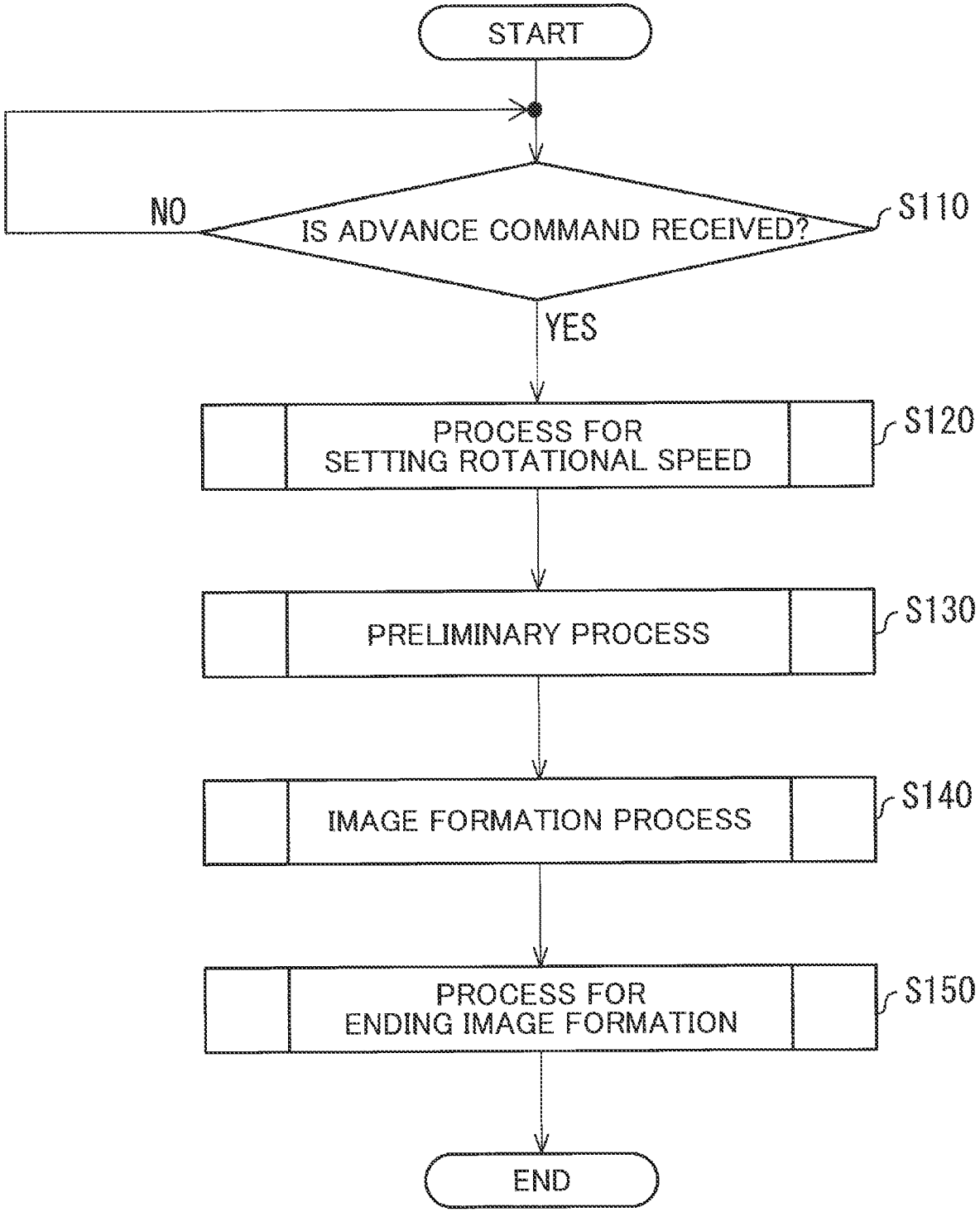
FIG. 5 is a flowchart showing operations performed on the image forming device.

Next, operations performed on the image forming device 1 will be described with reference to FIG. 5. FIG. 5 is a flowchart showing the order of operations performed on the image forming device 1. Unless otherwise noted, the processing entity for the steps described below is the image forming device 1, and more specifically the CPU 111 of the image forming device 1.

In S110 of FIG. 5, the image forming device 1 determines whether an advance command was received from the external terminal 2 ahead of image formation data and repeats this determination while an advance command has not been received (S110: NO). The image forming device 1 can accept image formation data transmitted from the external terminal 2 in parallel to the process shown in FIG. 5 after YES determination is made in S110. When an advance command is received from the external terminal 2 (S110: YES), in S120 the image forming device 1 executes a process for setting rotational speed. In this process, the image forming device 1 sets the rotational speed for the heating roller 105*a* (i.e., the rotational speed for the motor M) at which the heating roller 105*a* will rotate during a preliminary process in S130 and an image formation process in S140 described below. The process in S120 for setting rotational speed will be described later in greater detail with reference to FIG. 6. The image forming device 1 may receive the image formation data transmitted from the external terminal 2 during or after execution of the process of S120.

In the embodiment, the rotational speed in S120 may be either a first speed, or a second speed that is slower than the first speed. Below, the first speed denotes full speed while the second speed denotes half speed, where half speed is 50% of full speed. However, the present disclosure is not limited to these settings. For example, when the first speed is full speed, the second speed may be 75% of full speed or 25% of full speed.

Next, the image forming device 1 executes a preliminary process in S130. In this process, the image forming device 1 drives the motor M to rotate the heating roller 105*a* and activates the heater H to heat the heating roller 105*a*, thereby increasing the temperature in the fixing portion 105. In the preliminary process of S130 the CPU 111 and the motor driver 105*b* control the motor M to rotate the heating roller 105*a* at the rotational speed set in S120. For example, in a case that the rotational speed set in S120 is the half speed, the CPU 111 and the motor driver 105*b* control the motor M to rotate the heating roller 105*a* at the half speed. In a case that the rotational speed was set to the full speed in S120, the CPU 111 and motor driver 105*b* control the motor M to rotate the heating roller 105*a* at the full speed. The preliminary process of S130 will be described later in greater detail with reference to FIG. 7. The image forming device 1 may receive the image formation data transmitted from the external terminal 2 during or after execution of the process of S130.

Next, the image forming device 1 executes an image formation process in S140. In this process, the image forming device 1 forms an image on a sheet S according to the image formation data received from the external terminal 2. As will be described later, the rotational speed of the heating roller 105*a* during the image formation process of S140 matches the rotational speed of the heating roller 105*a* in the preliminary process of S130. Therefore, there is no need to change the rotational speed of the motor M when transitioning from the preliminary process to the image formation process. The image formation process of S140 will be described later in greater detail with reference to FIG. 8. The image forming device 1 may receive the image formation data transmitted from the external terminal 2 during execution of the process of S140.

Next, the image forming device 1 executes a process in S150 for ending image formation. In the process of S150 the image forming device 1 halts rotation of the heating roller 105*a* by the motor M and halts heating of the heating roller 105*a* by the heater H. The process of S150 will be described later in greater detail with reference to FIG. 9.

Process for Setting Rotational Speed

Figure 6:
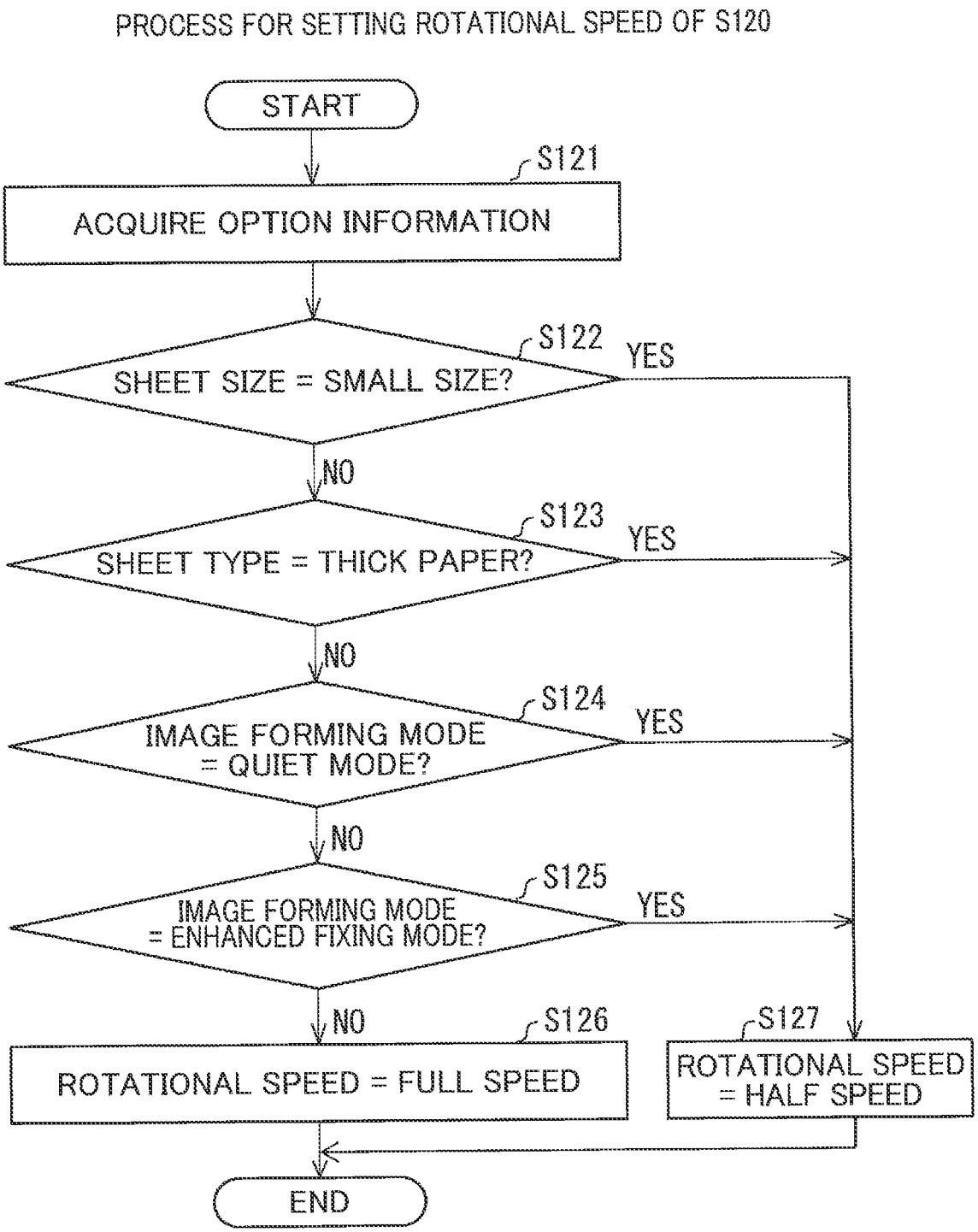
FIG. 6 is a flowchart showing a process for setting rotational speed.

The process of S120 in FIG. 5 for setting rotational speed will be described in detail with reference to FIG. 6. FIG. 6 is a flowchart illustrating steps in the process for setting rotational speed. Unless otherwise noted, the processing entity of the steps described below is the image forming device 1, and more specifically the CPU 111 of the image forming device 1.

In the process for setting rotational speed of S120, in S121 the image forming device 1 acquires the option information included in the advance command received from the external terminal 2. As described above, this option information includes the sheet size information, the sheet type information, and the image forming mode information. The image forming device 1 interprets the option information, which is described in PJL, to identify the sheet size specified by the sheet size information, the sheet type specified by the sheet type information, and the image forming mode specified by the image forming mode information.

In S122 the image forming device 1 determines whether the sheet size specified by the sheet size information denotes a small size. When the sheet size is a small size (S122: YES), in S127 the image forming device 1 sets the rotational speed to the half speed. Here, the small size indicates that the sheet size is at least 1 centimeter smaller than letter size, for example.

In a case that the sheet size is not a small size (S122: NO), in S123 the image forming device 1 determines whether the sheet type specified by the sheet type information is a thick paper. In a case that the sheet type is the thick paper (S123: YES), in S127 the image forming device 1 sets the rotational speed to the half speed.

However, in a case that the sheet type is not thick paper (S123: NO), in S124 the image forming device 1 determines whether the image forming mode specified by the image forming mode information is the quiet mode. In a case that the image forming mode is the quiet mode (S124: YES), in S127 the image forming device 1 sets the rotational speed to the half speed.

However, in a case that the image forming mode is not the quiet mode (S124: NO), in S125 the image forming device 1 determines whether the image forming mode specified by the image forming mode information is the enhanced fixing mode. In a case that the image forming mode is the enhanced fixing mode (S125: YES), in S127 the image forming device 1 sets the rotational speed to the half speed.

However, in a case that the image forming mode is not the enhanced fixing mode (S125: NO), i.e., in a case that the image forming device 1 reaches a NO determination in all steps S122-S125, in S126 the image forming device 1 sets the rotational speed to the full speed.

In a case that a small-size sheet S is being printed in the image formation process of S140, the heating roller 105*a* must be driven at half speed. That is, since a small-size sheet S does not pass over the ends of the heating roller 105*a*, the temperature of the heating roller 105*a* must be reduced, and the rotational speed of the heating roller 105*a* must be reduced. As described above, when the rotational speed of the heating roller 105*a* is set to the half speed for the preliminary process of S130 in a case that the sheet S has a small size, the rotational speed of the heating roller 105*a* can be set the same in both the preliminary process of S130 and the image formation process of S140.

Further, in a case that the sheet S is thick paper, the heating roller 105*a* must be driven at the half speed during the image formation process of S140. That is, since heat transfer is relatively poor in thick sheets S, more time is required to heat the thick sheet S. As described above, when the rotational speed of the heating roller 105*a* is set to the half speed during the preliminary process of S130 in a case that the sheet S is thick paper, the rotational speed of the heating roller 105*a* can be set the same in both the preliminary process of S130 and the image formation process of S140.

Further, in a case that the image forming mode is the quiet mode, the heating roller 105*a* must be driven at the half speed during the image formation process of S140. That is, the motor noise during conveyance must be reduced in a case that the image forming mode is the quiet mode. As described above, when the rotational speed of the heating roller 105*a* is set to the half speed during the preliminary process of S130 in a case that the image forming mode is the quiet mode, the rotational speed of the heating roller 105*a* can be set the same in both the preliminary process of S130 and the image formation process of S140.

Further, in a case that the image forming mode is the enhanced fixing mode, the heating roller 105*a* must be driven at the half speed during the image formation process of S140. That is, in a case that the image forming mode is the enhanced fixing mode, it is necessary to take more time in order to reliably heat the sheet S with the heating roller 105*a*. As described above, when the rotational speed of the heating roller 105*a* is set to the half speed for the preliminary process of S130 in a case that the image forming mode is the enhanced fixing mode, the rotational speed of the heating roller 105*a* can be set the same in both the preliminary process of S130 and the image formation process of S140.

While the embodiment describes a case of setting the rotational speed of the heating roller 105*a* by referencing the image forming mode information included in the advance command as option information, the present disclosure is not limited to this configuration. For example, the image forming mode information may be set via the operating panel 15 and stored in the ROM 12 or the RAM 13, and the rotational speed of the heating roller 105*a* may be set by referencing the stored image forming mode information. In this case, the CPU 111 of the image forming device 1 would set the rotational speed of the heating roller 105*a* based on the image forming mode information stored in the ROM 12 or RAM 13 of the image forming device 1 in addition to the sheet size information and the sheet type information included in the advance command as option information. The CPU 111 of the image forming device 1 may set the rotational speed of the heating roller 105*a* based on the image forming mode information stored in the ROM 12 or RAM 13 of the image forming device 1, in addition to the sheet size information and the sheet type information included in the advance command as option information, as long as the image forming mode information is not included in the advance command as option information.

Preliminary Process

Figure 7:
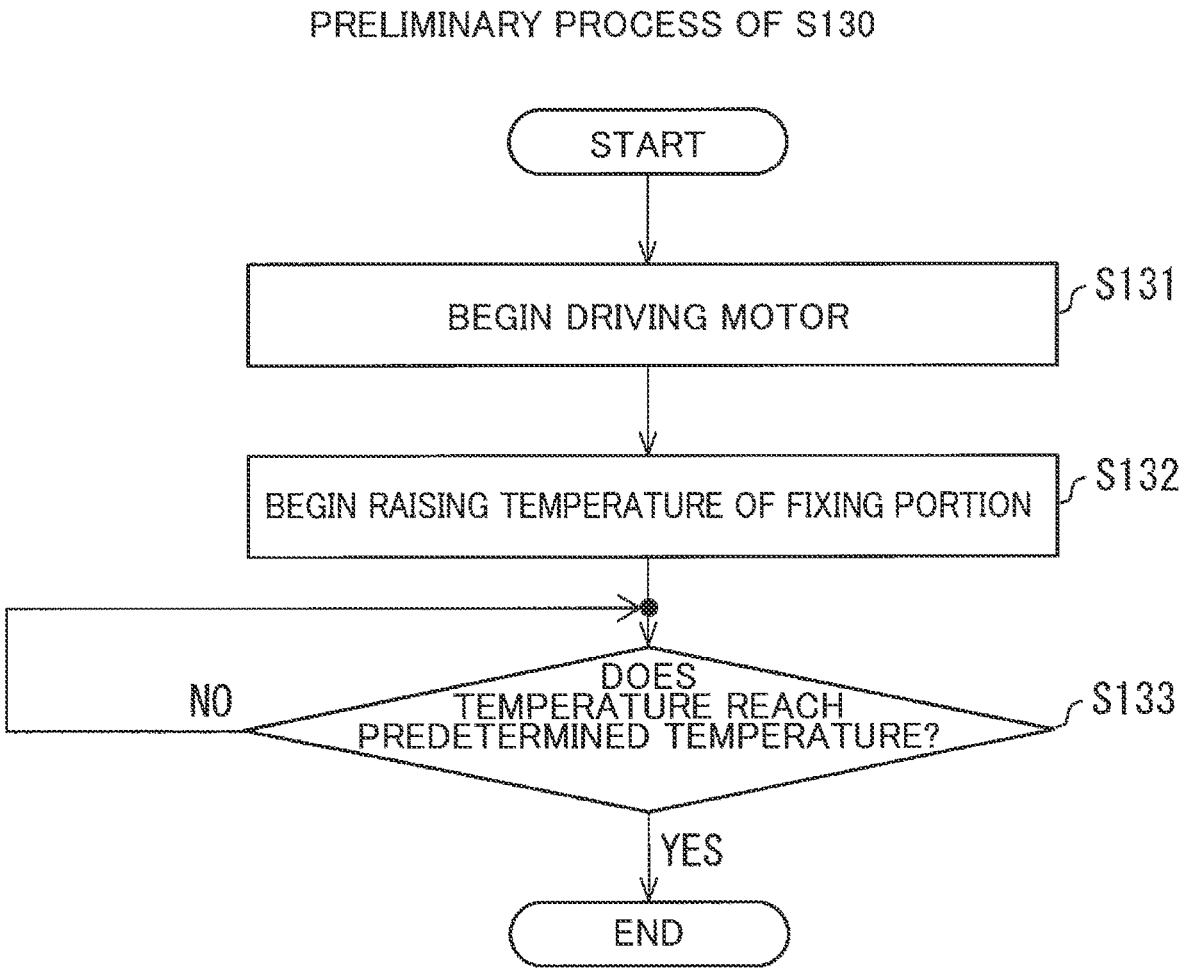
FIG. 7 is a flowchart showing a preliminary process.

Next, the preliminary process of S130 in FIG. 5 will be described in detail with reference to FIG. 7. FIG. 7 is a flowchart illustrating steps in the preliminary process. Unless otherwise noted, the processing entity of the steps described below is the image forming device 1, and more specifically the CPU 111 of the image forming device 1.

In the preliminary process of S130, in S131 the image forming device 1 begins driving the motor M to rotate the heating roller 105*a*. The motor driver 105*b* driving the motor M at this time controls the motor M so that the rotational speed of the motor M, i.e., the rotational speed of the heating roller 105*a*, matches the rotational speed set in S120.

In S132 the image forming device 1 begins raising the temperature of the heating roller 105*a* using the heater H. In S133 the image forming device 1 determines whether the temperature of the heating roller 105*a* has reached a predetermined temperature and repeats the determination while the temperature has not reached the predetermined temperature (S133: NO). When the temperature of the heating roller 105*a* has reached the predetermined temperature (S133: YES), the image forming device 1 ends the preliminary process.

PJL Analysis and RIP Process

As described above, the image forming device 1 can accept image formation data transmitted from the external terminal 2 after YES determination is made in S110. In a case the image formation data is received from the external terminal 2, the CPU 11 performs following an analysis of PJL and a process performed with a raster image processor (RIP process) on the received image formation data. The CPU 111 executes the PJL analysis and the RIP process in parallel with the process described in the flowchart of FIG. 5.

Specifically, the image forming device 1 executes the PJL analysis and the RIP process upon receiving image formation data from the external terminal 2. Here, the PJL analysis denotes a process in which the CPU 111 analyzes the PJL included in the image formation data to identify the method for forming images on sheets S. The RIP process denotes a process for analyzing or interpreting the PDL included in the image formation data to generate raster data representing images to be formed on sheets S. The CPU 111 stores this raster data in the page memory 132 of the RAM 13. Raster data is data for each page. In a case that the image formation data includes a plurality of pages worth of raster data, the above process is complete once the CPU 111 has executed the PJL analysis and the RIP process on all image formation data for the plurality of pages. The CPU 111 registers a print job for forming an image based on the generated raster data in an image formation queue.

Image Formation Process

Figure 8:
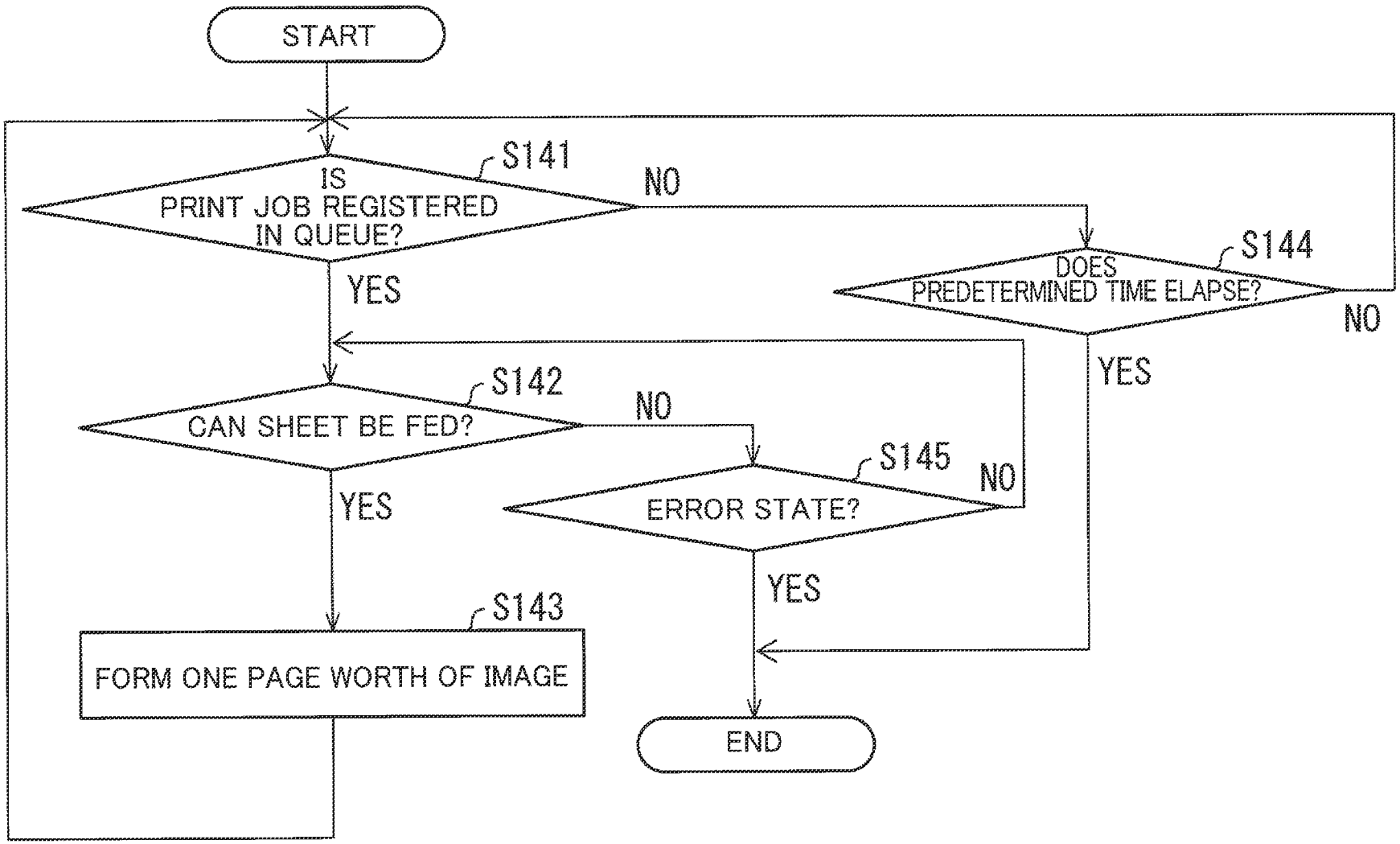
FIG. 8 is a flowchart showing an image formation process.

Next, the image formation process of S140 in FIG. 5 will be described in detail with reference to FIG. 8. FIG. 8 is a flowchart illustrating steps in the image formation process. Unless otherwise noted, the processing entity of the steps described below is the image forming device 1, and more specifically the CPU 111 of the image forming device 1.

In the image formation process of S140, in S141 the CPU 111 determines whether a print job is registered in the image formation queue, or whether raster data is stored in the page memory 132. The CPU 111 advances to S142 when raster data is stored in the page memory 132 (S141: YES). The CPU 11 advances to S144 when raster data is not stored in the page memory 132 (S141: NO).

In S142 the image forming device 1 determines whether a sheet S can be fed. When the image forming device 1 determines that a sheet S can be fed (S142: YES), in S143 the image forming device 1 forms an image represented by the raster data in the page memory 132 on the sheet S. After completing image formation on the sheet S for an image represented by one page worth of raster data, the CPU 111 deletes the raster data used for this image formation from the page memory 132. Subsequently, the CPU 111 returns to S141. In S141 the CPU 111 confirms whether raster data is still stored in the page memory 132.

When no raster data is stored in the page memory 132 (S141: NO), the image forming device 1 waits for a predetermined time to elapse (S144: NO). In a case NO determination is made in S144, the CPU 111 returns to the process of S141. In a case that the predetermined time has elapsed (S144: YES), the image forming device 1 ends the image formation process of S140 without forming an image on a sheet S. Further, in a case that a sheet S cannot be fed (S142: NO), in S145 the image forming device 1 determines whether an error state was detected. The image forming device 1 returns to S142 in a case that an error state was not detected (S145: NO). In a case that an error state was detected (S145: YES), the image forming device 1 ends the image formation process of S140 without forming an image on a sheet S.

Process for Ending Image Formation

Figure 9:
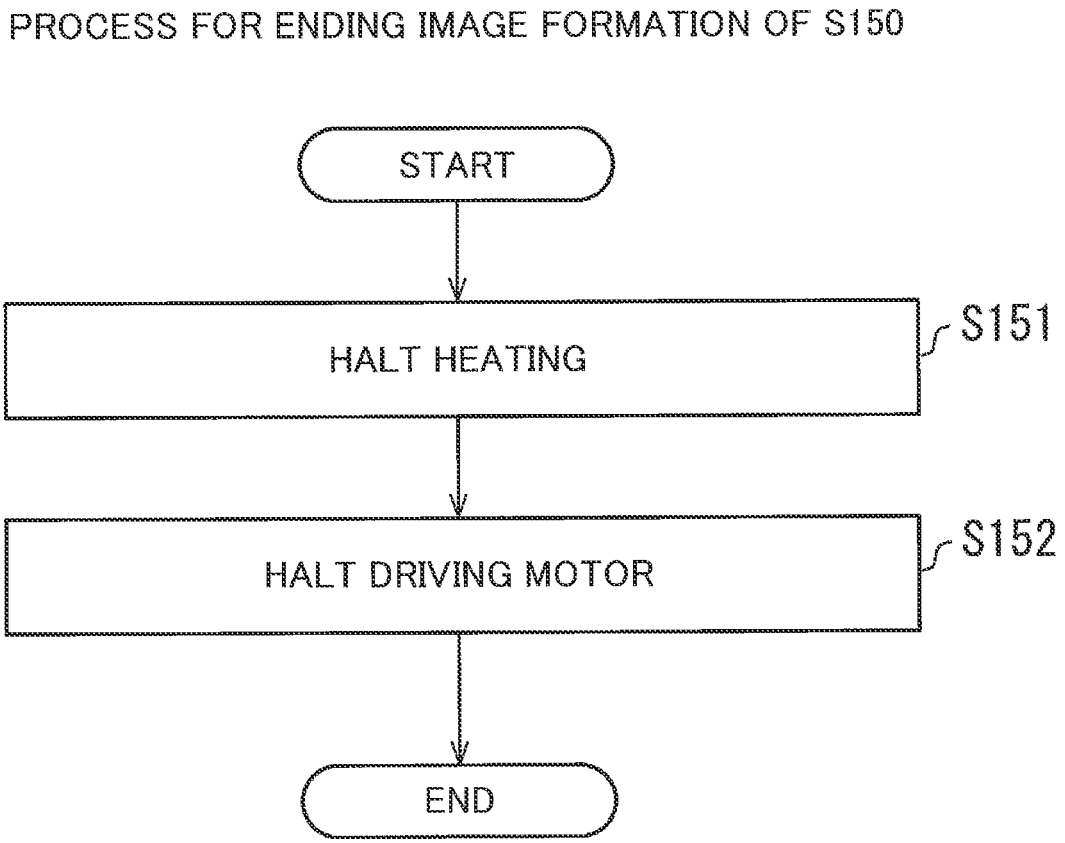
FIG. 9 is a flowchart showing a process for ending image formation.

Next, the process of S150 in FIG. 5 for ending image formation will be described in detail with reference to FIG. 9. FIG. 9 is a flowchart illustrating steps in the process. Unless otherwise noted, the processing entity of the steps described below is the image forming device 1, and more specifically the CPU 111 of the image forming device 1.

In the process for ending image formation of S150, in S151 the image forming device 1 halts heating of the heating roller 105*a* with the heater H that was begun in the preliminary process of S130. In S152 the image forming device 1 halts rotation of the motor M that drives the heating roller 105*a*.

Sample Operations on the Image Forming Device

Figure 10:
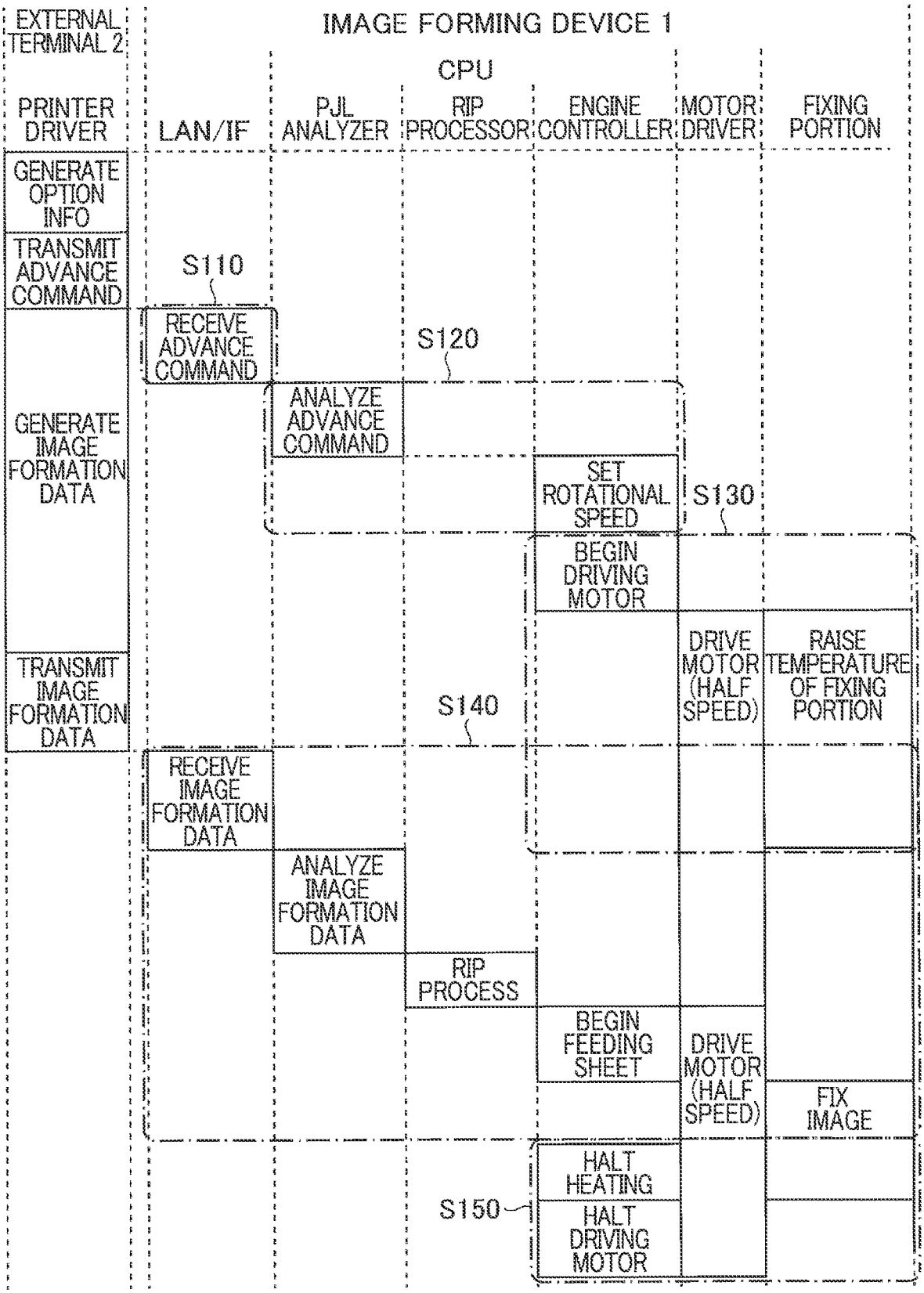
FIG. 10 is a timing chart showing sample operations on the image forming device.

An example of operations performed on the image forming device 1 will be described with reference to FIG. 10. FIG. 10 is a timing chart showing sample operations on the image forming device 1. In FIG. 10, the configurations of the image forming device 1 is divided into the LAN interface 14, a PJL analyzer, a RIP processor, an engine controller, the motor driver 105*b*, and the fixing portion 105. FIG. 10 shows the process executed by each of these components. The PJL analyzer, the RIP processor, and the engine controller are all function blocks implemented by the CPU 111.

In the sample operations shown in FIG. 10, the rotational speed of the heating roller 105*a* is set to the half speed for the preliminary process of S130 based on the advance command acquired from the external terminal 2. Therefore, when transitioning from the preliminary process of S130 to the image formation process of S140, there is no need to change the rotational speed of the motor M driving the heating roller 105*a*. Accordingly, the image forming device 1 can transition quickly from the preliminary process of S130 to the image formation process of S140. Further, in a case that the rotational speed of the heating roller 105*a* is at the half speed for the image formation process of S140, the level of noise generated by the image forming device 1 prior to beginning the image formation process of S140 can be reduced since the rotational speed of the heating roller 105*a* is also at the half speed during the preliminary process of S130.

First Variation

The embodiment describes a case in which the advance command transmitted from the external terminal 2 includes the sheet size information, the sheet type information, and the image forming mode information as option information, and the image forming device 1 sets the rotational speed of the heating roller 105*a* based on this information, but the present disclosure is not limited to this configuration. For example, the external terminal 2 may set the rotational speed of the heating roller 105*a* based on the sheet size, the sheet type, and the image forming mode and may transmit an advance command to the image forming device 1 that includes rotational speed information specifying this rotational speed as option information. In this case, the external terminal 2 executes a process conforming to the rotational speed setting process of S120. Further, the image forming device 1 sets the rotational speed of the heating roller 105*a* based on the rotational speed information included in the advance command as option information.

Second Variation

While the image forming device 1 is configured to always execute the preliminary process of S130 of the embodiment, the present disclosure is not limited to this configuration. For example, the image forming device 1 may be configured to execute the preliminary process of S130 when the rotational speed is set to the full speed in the process of S120 and to omit the preliminary process of S130 when the rotational speed is set to the half speed in S120.

Figure 11:
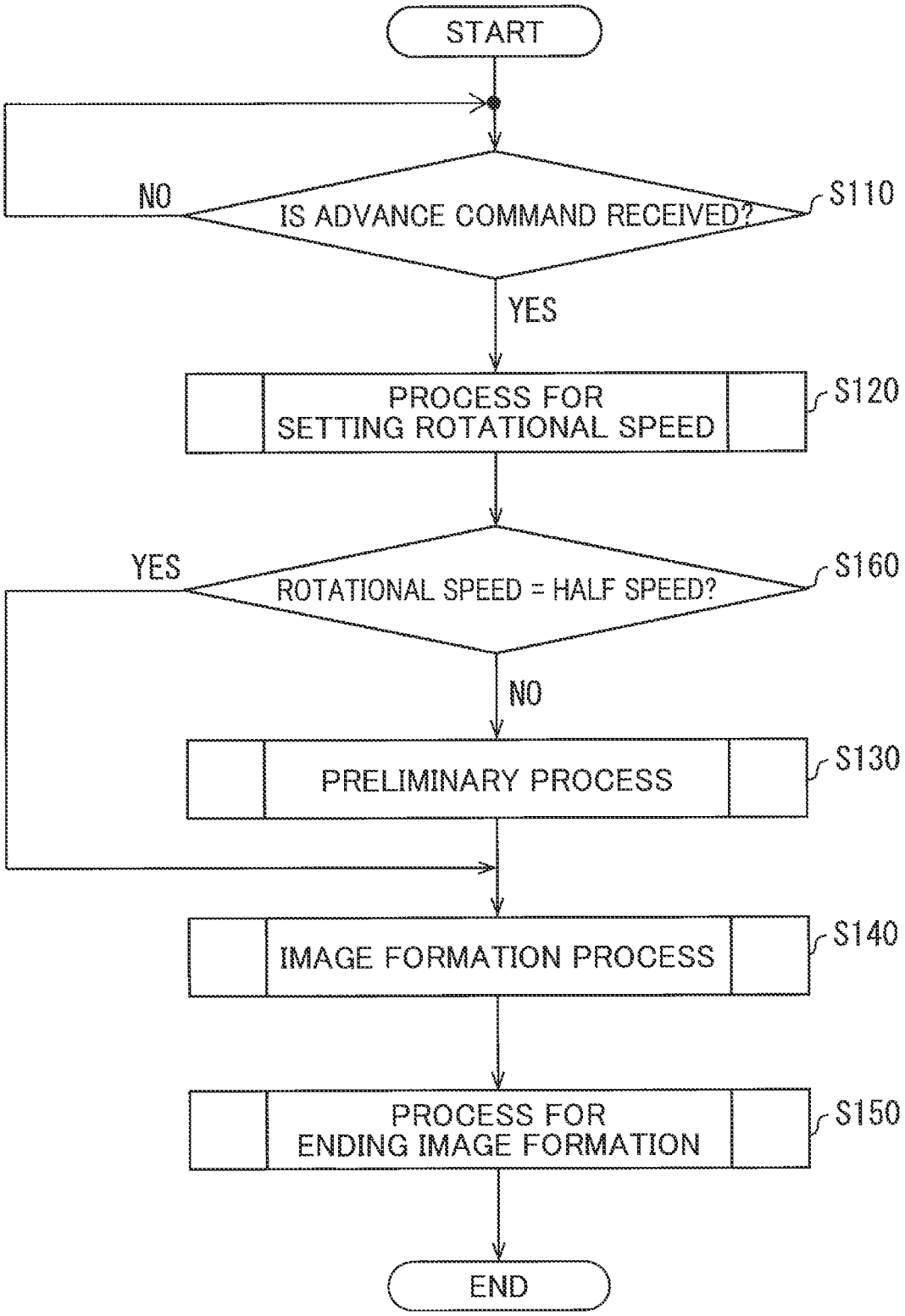
FIG. 11 is a flowchart showing operations performed on the image forming device.

FIG. 11 is a flowchart showing the order of operations performed by the image forming device 1 in the second variation. The flowchart in FIG. 11 is identical to that in FIG. 5 with the addition of a step S160 for determining whether the rotational speed was set to the half speed in S120. Here, the image forming device 1 executes the preliminary process of S130 only when the rotational speed set in S120 is not the half speed, e.g., is the full speed (S160: NO). Thus, the image forming device 1 executes the preliminary process in S130 immediately following the rotational speed setting process of S120 in a case that the rotational speed was not set to the half speed in S120. The image forming device 1 does not execute the preliminary process of S130 immediately following the process of S120 in a case that the rotational speed was set to the half speed in S120. In a case that the rotational speed was set to half speed in S120, the image forming device 1 waits until the image formation data is received from the external terminal 2, and executes a process equivalent to the preliminary process of S130 after receiving the image formation data and subsequently executes a process equivalent to the image formation process of S140, for example.

The process equivalent to the preliminary process of S130 and the image formation process are executed after receiving image formation data in a case that the preliminary process of S130 is not performed when the rotational speed is the half speed. Accordingly, the rotational speed of the motor need not be switched. Hence, no time is lost for changing the rotational speed of the motor, enabling the transition to the image formation process to be performed quickly. Further, the preliminary process of S130 is omitted when the rotational speed for the heating roller 105*a* is set to the half speed for the image formation process. Accordingly, noise generated by the image forming device 1 prior to starting the image formation process can be avoided.

The flowcharts in FIGS. 4-9 and 11 do not limit the present invention to the steps indicated therein. Steps may be added or deleted, or their order may be rearranged.

EXAMPLE TO IMPLEMENT THE PROCESS BY SOFTWARE

The control block of the image forming device 1 may be implemented by logic circuits formed on an integrated circuit (IC chip) or the like or may be implemented through software.

In the latter case, the image forming device 1 is provided with a computer to execute instructions in a program, which is software for implementing each function. This computer is provided with one or more processors, and a computer-readable storage medium for storing the program described above, for example. In this computer, the processor reads the program from the storage medium and executes the program to attain the objects of the present disclosure. A central processing unit (CPU) may be used as the processor, for example. The storage medium may be a "non-transitory, tangible medium," such as ROM, a tape, a disc, a card, semiconductor memory, or a programmable logic circuit. Random-access memory (RAM) may also be provided for developing the program. The program may also be supplied to the computer described above via any transmission medium (a communication network, broadcast waves, etc.) capable of transmitting the program. Note that one aspect of this specification is that the program can be implemented in the form of data signals embedded in a carrier wave, as embodied in electronic transmission.

Supplementary Information

While the disclosure has been described in detail with reference to the specific embodiment thereof, it would be apparent to those skilled in the art that various changes and modifications may be made therein without departing from the scope of the invention.

What is claimed is:

1. An image forming device comprising:

an image forming member including:

a photosensitive drum configured to form an image on a sheet based on image formation data transmitted from an external terminal;

a roller configured to convey the sheet; and a motor configured to provide the roller with driving force to rotate the roller; and a controller configured to perform:

acquiring an advance command which is received from the external terminal prior to reception of the image formation data, the advance command including option information which is for determining a rotational speed of the roller;

determining the rotational speed of the roller based on the option information, the rotational speed being determined to be changeable depending on the option information; and in response to acquiring the advance command, a preliminary process, the image formation data being received during or after execution of the preliminary process, the preliminary process being to control the motor so that the roller rotates at the rotational speed determined in the determining.

2. The image forming device according to claim 1, wherein the controller performs the preliminary process in a case that the determined rotational speed is a first speed, whereas the controller does not perform the preliminary process in a case that the determined rotational speed is a second speed different from the first speed.

3. The image forming device according to claim 1, wherein in a case that the determined rotational speed is a first speed, the controller controls the roller to rotate at the first speed in the preliminary process whereas in a case that the determined rotational speed is a second speed different from the first speed, the controller controls the roller to rotate at the second speed in the preliminary process.

4. The image forming device according to claim 1, wherein the option information includes specification information specifying at least one of a sheet size, a sheet type, or an image formation mode for forming an image on the sheet, wherein in the determining, the controller determines the rotational speed based on the specification information.

5. The image forming device according to claim 4, wherein in the determining, the controller determines the rotational speed based on internally-stored specification information in addition to the option information, the internally-stored specification information being stored in the image forming device and specifying an image formation mode.

6. The image forming device according to claim 4, wherein in the determining, in a case that the option information does not include the specification information specifying the image formation mode, the controller determines the rotational speed based on internally-stored specification information in addition to the option information, the internally-stored specification information being stored in the image forming device and specifying an image formation mode.

7. The image forming device according to claim 1, wherein the option information includes specification information selectively specifying one of a first speed or a second speed different from the first speed for the rotational speed of the roller, wherein in the determining, the controller determines the rotational speed to select one of the first speed or the second speed based on the specification information.

8. The image forming device according to claim 1, wherein the image forming member further includes a heater, wherein the roller is heated by the heater.

9. The image forming device according to claim 1, wherein the image forming member further includes a fixing member configured to thermally fix a toner image to the sheet, the fixing member including a heater and the roller, wherein the preliminary process begins driving the motor so that the roller rotates at the rotational speed determined in the determining, and raising a temperature of the heater, wherein the controller is configured to further perform:

after the raising the temperature of the heater is completed and the image formation data is received, an image forming process to control the image forming member to form an image on the sheet based on the image formation data; and after the image forming process is completed, halting both heating the heater and driving the motor.

10. A method comprising:

acquiring an advance command which is received from an external terminal prior to reception of image formation data, the advance command including option information which is for determining a rotational speed of a roller;

determining the rotational speed of the roller provided in an image forming member based on the option information, the rotational speed being determined to be changeable depending on the option information, the roller being configured to convey a sheet; and in response to acquiring the advance command, performing a preliminary process, the image formation data being received during or after execution of the preliminary process, the preliminary process being to control a motor provided in the image forming member so that the roller rotates at the rotational speed determined in the determining, the motor being configured to provide the roller with driving force to rotate the roller.

* * * * *